US006194347B1

(12) United States Patent
Narita et al.

(10) Patent No.: US 6,194,347 B1
(45) **Date of Patent: *Feb. 27, 2001**

(54) THERMAL TRANSFER IMAGE RECEIVING SHEET AND METHOD OF MANUFACTURING SAME

(75) Inventors: Satoshi Narita; Yoshinori Kamikubo, both of Tokyo-to (JP)

(73) Assignee: Dai Nippon Printing Co., Ltd., Tokyo-to (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/997,429

(22) Filed: Dec. 23, 1997

(30) Foreign Application Priority Data

Dec. 27, 1996 (JP) ..... 8-356575

(51) Int. Cl.[7] ..... B41M 5/035; B41M 5/38

(52) U.S. Cl. ..... 503/227; 427/152; 428/304.4

(58) Field of Search ..... 8/471; 428/195, 428/304.4, 913, 914; 503/227; 427/152

(56) References Cited

FOREIGN PATENT DOCUMENTS 61-164892 * 7/1986 (JP) ..... 503/227
61-232517 * 9/1986 (JP) ..... 503/227
61-270192 * 11/1986 (JP) ..... 503/227

* cited by examiner

*Primary Examiner*—Bruce H. Hess
(74) *Attorney, Agent, or Firm*—Ladas & Parry

(57) ABSTRACT

A method of manufacturing a thermal transfer image receiving sheet which comprises a substrate made of a paper comprising essentially pulp, an intermediate layer disposed on said substrate and a receptor layer disposed on said intermediate layer, comprising steps of: forming said intermediate layer having a structure comprising fine pores on said substrate, and forming said receptor layer on said intermediate layer.

14 Claims, 2 Drawing Sheets

THERMAL TRANSFER IMAGE RECEIVING SHEET AND METHOD OF MANUFACTURING SAME

BACKGROUND OF THE INVENTION

1. Field of the Invention

The present invention relates to a thermal transfer image receiving sheet which is used in combination with a thermal transfer sheet. More specifically, the present invention relates to a thermal transfer image receiving sheet having the same texture and appearance as a plain paper, and the method of manufacturing same.

2. Description of the Related Art

Various types of the thermal transfer recording have been used. As one of the above types, there is known a sublimation type transfer recording. In the sublimation type transfer recording, a thermal head, which generates heat in response to recorded signals, transfers a sublimation dye used as a coloring material onto a thermal transfer image receiving sheet to obtain an image. Recently, the sublimation type transfer recording is applied as an information recording means in various fields. Since the sublimation dye is used as a coloring material, the gradation of a printing density can be controlled as required to reproduce a full color image in accordance with the original image in the sublimation type transfer recording. Furthermore, since the image formed of the dye is very clear and excellent in transparency, the reproduction of intermediate colors and the reproduction of gradation in the image is excellent, thus enabling to form a high quality image comparable to a silver photographic image.

A thermal transfer image receiving sheet using an usual paper as the substrate thereof is proposed as one of the thermal transfer image receiving sheets for the sublimation type transfer recording. The printed matter formed from the thermal transfer image receiving sheet using the usual paper has a comparable quality such as gloss of the surface and the thickness thereof to a printed matter obtained by an usual offset printing or gravure printing. The above thermal transfer image receiving sheet using the usual paper as the substrate thereof can be bent, in addition, a bookbinding or filing thereof is possible even if the thermal transfer image receiving sheets are superposed, contrary to the thermal transfer image receiving sheet using a conventional synthetic paper as the substrate thereof, thus enabling to be used in a various manner. Furthermore, since the usual paper is cheaper than the synthetic paper, it is possible to manufacture the thermal transfer image receiving sheet at a lower cost.

In the above thermal transfer image receiving sheet, a layer having a higher cushion property, for example, a foam layer comprising a resin and a foaming agent, is formed between a substrate and a receptor layer in order to make up the cushion property and the thermal insulating property of the substrate. Thus, a cushion property is provided with the thermal transfer image receiving sheet to improve the fitting property between the thermal transfer image receiving sheet and the thermal transfer sheet. Furthermore, an intermediate layer is further disposed between the foam layer and the receptor layer to prevent the foam layer from being collapsed by heating or pressing upon printing.

In a thermal transfer image receiving sheet in which a foam layer, an intermediate layer and a receptor layer are disposed in this order in layers on such a paper substrate, there is a problem in which a deterioration of the printing quality occurs upon printing in a specific condition.

More specifically, when an image having a lower gradation is printed as the first color at first, and then an image having a higher gradation is printed so as to register with the same region printed with the first color to form a mixed coloring image containing the secondary color or the tertiary color, the gradation becomes discontinuous, after the printing with all colors is finished, to produce a decoloring in a pinhole shape on the printed surface. In the above decoloring portion, the image of the first color has a specific density, and the color density printed at the high gradation (i.e., the second color or the third color) becomes lower than a prescribed density.

The above phenomenon occurs, for example, in a case that an image of bluish green color is formed by printing with light yellow as the first color and mazarine blue as the second color, or that an image of bluish purple color is formed by printing with light red as the first color and mazarine blue as the second color.

This phenomenon is more clearly recognized by observation when the image of the first color comprises many different gradations throughout a low to a high densities, and furthermore the density of the first color continuously and gently changes across the printed image. In the case that the image of the first color is printed in the above manner, the color density of the second color or the third color lowers only in the portions where the image of the first color has the specific density, thus whitish linear portions appear in the printed image.

The above mentioned deterioration in the image quality remarkably lowers the quality of the printed matter, thus extremely lowering the product value. From observing the surface of the printed matter with a microscope, the reason of the above phenomenon is considered to be that the receptor layer is fused and adhered to the thermal transfer sheet when the second or third color is printed, and the receptor layer is peeled off the intermediate layer. More specifically, when the gradation value of the first color is within a specific range, it is seemed that both of the adhesive strength between the receptor layer and the intermediate layer, and the release ability of the receptor layer with respect to the thermal transfer sheet vary depending on the heat history of the receptor layer and reach the following relationship:

Adhesive strength between the receptor layer and the intermediate layer<Adhesive strength between the receptor layer and the thermal transfer sheet.

SUMMARY OF THE INVENTION

The object of the present invention is to provide a thermal transfer image receiving sheet which has the same quality in gloss and surface features as a paper, and by which a high quality of image excellent in the reproduction of both of intermediate colors and gradation can be formed, and in addition, the discontinuity in gradation produced by a decoloring in a pin hole shape in a specific mixed coloring image can be prevented from occurring, and to provide the method of manufacturing same.

To attain the above object, there is provided a method of manufacturing a thermal transfer image receiving sheet which comprises a substrate made of a paper comprising essentially pulp, an intermediate layer disposed on said substrate and a receptor layer disposed on said intermediate layer, comprising steps of: forming said intermediate layer having a structure comprising fine pores on said substrate, and forming said receptor layer on said intermediate layer.

The method preferably comprises that the receptor layer is formed by applying a coating liquid for a receptor layer on the intermediate layer.

The method preferably comprises that the intermediate layer containing a binder resin is formed on the substrate, and the receptor layer is formed by applying a coating liquid for a receptor layer containing an organic solvent on the intermediate layer.

The method preferably comprises that a coating liquid for an intermediate layer containing resin particles having a diameter of 0.1 to 2 $\mu$m is applied on the substrate and dried to form the intermediate layer having the structure comprising the fine pores.

The method preferably comprises that a coating liquid for an intermediate layer containing a high polymer resin, a good solvent and a bad solvent having a boiling point higher than the good solvent is applied on the substrate and dried to form the intermediate layer having the structure comprising the fine pores.

The method preferably comprises that 10 to 70 weight parts of the bad solvent is used to 100 weight parts of the high polymer resin.

Furthermore, there is provided a thermal transfer image receiving sheet comprises a substrate made of a paper comprising essentially pulp, an intermediate layer having a structure comprising fine pores and a receptor layer, the intermediate layer and the receptor layer being disposed in order from the substrate.

The thermal transfer image receiving sheet preferably comprises that the receptor layer is formed by applying a coating liquid for a receptor layer on the intermediate layer.

The thermal transfer image receiving sheet preferably comprises that the intermediate layer contains a binder resin, and the receptor layer is formed by applying a coating liquid for a receptor layer containing an organic solvent on the intermediate layer.

The thermal transfer image receiving sheet preferably comprises that the intermediate layer contains resin particles having a diameter of 0.1 to 2 $\mu$m.

The thermal transfer image receiving sheet preferably comprises that the intermediate layer is formed on the substrate by applying a coating liquid for an intermediate layer containing a high polymer resin, a good solvent and a bad solvent having a boiling point higher than the good solvent, and dried.

The thermal transfer image receiving sheet preferably comprises that a foam layer is disposed between the substrate and the intermediate layer.

The thermal transfer image receiving sheet preferably comprises that an undercoat layer is disposed between the substrate and the foam layer.

The thermal transfer image receiving sheet preferably comprises that an anti-curl layer is disposed on an opposite surface of the substrate with the receptor layer formed thereon.

In a method of manufacturing a thermal transfer image receiving sheet of the present invention comprising a step that at least an intermediate layer and a receptor layer are disposed on a substrate made of a paper comprising essentially pulp, the intermediate layer and the receptor layer being disposed in order from the substrate, the adhesive strength between the receptor layer and the intermediate layer is improved by forming the intermediate layer, which has a structure comprising fine pores, on the substrate, and then forming the receptor layer on the intermediate layer. This enables to overcome the deterioration of the image quality when printed with mixed colors, i.e., the discontinuity in the gradation of the printed image.

More specifically, when the coating liquid for the receptor layer is applied on the intermediate layer having a structure comprising the fine pores, the coating liquid permeates into the fine pores. The above permeation of the coating liquid causes the intermediate layer and the receptor layer to be mixed along the interface therebetween, thus improving the adhesive strength between both the layers. Furthermore, when the coating liquid for the receptor layer containing an organic solvent is applied on the intermediate layer, the coating liquid dissolves the binder resin contained in the intermediate layer to accelerate the above mixing and fusion along the interface therebetween, thus further improving the adhesive strength between both the layers.

Furthermore, since the thermal transfer image receiving sheet of the present invention comprises a substrate made of a paper comprising essentially pulp, an intermediate layer having a structure comprising fine pores and a receptor layer, wherein the intermediate layer and the receptor layer are disposed in order from the substrate, the thermal transfer image receiving sheet has the same texture (e.x., gloss, surface features or the like) as a paper, and it is possible to form a high quality of image excellent in reproducibility of intermediate colors and gradation, and to enable to prevent discontinuity in gradation in a specifically mixed coloring image from occurring, as described above in detail.

DETAILED DESCRIPTION OF PREFERRED EMBODIMENTS

Now, embodiments of the thermal transfer image receiving sheet and the method of manufacturing same of the present invention are described in detail with reference to the drawings.

Figure 1:
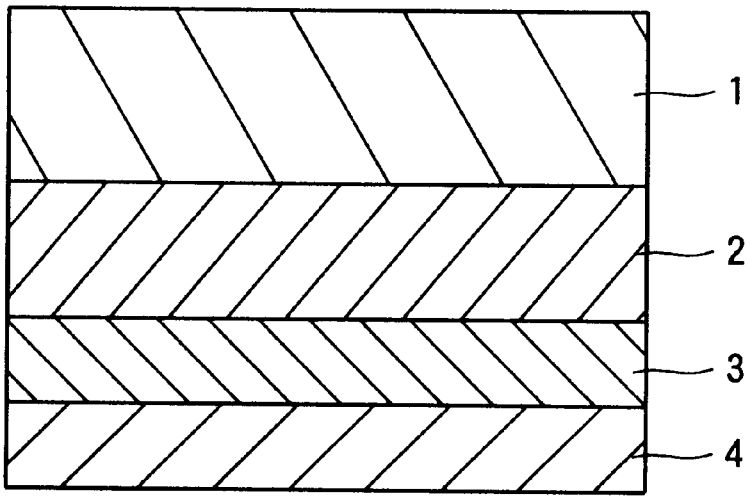
FIG. 1 is a schematic sectional view illustrating one embodiment of the thermal transfer image receiving sheet of the present invention.
Figure 2:
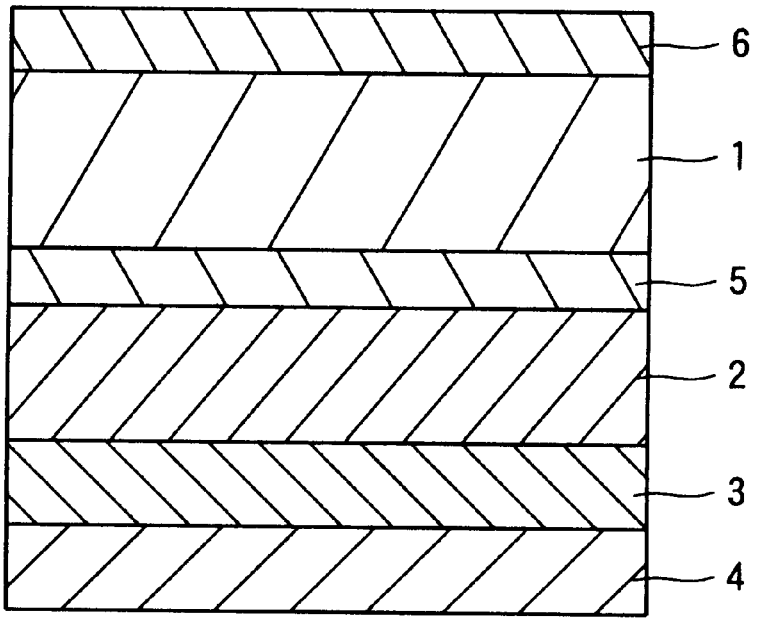
FIG. 2 is a schematic sectional view illustrating another embodiment of the thermal transfer image receiving sheet of the present invention.

FIG. 1 is a schematic sectional view illustrating one embodiment of the thermal transfer image receiving sheet of the present invention. The thermal transfer image receiving sheet of the present invention comprises a substrate 1 and at least an intermediate layer 3 and a receptor layer 4, as shown in FIG. 1, in which the intermediate layer 3 and the receptor layer 4 are disposed in this order on one surface of the substrate 1. It is preferable to further dispose a foam layer 2 between the substrate 1 and the intermediate layer 3. Furthermore, as shown in FIG. 2, it is more preferable to dispose an undercoat layer 5 between the substrate 1 and the foam layer 2, as well as an anti-curl layer 6 on the other surface of the substrate 1.

[SUBSTRATE]

As the substrate 1, an usually used paper comprising essentially of pulp, i.e., a plain paper is used. For example, a wood free paper, an art paper, a lightweight coated paper, a slightly coated paper, a coated paper, a cast coated paper, a synthetic resin or emulsion impregnated paper, a synthetic rubber latex impregnated paper, a synthetic resin lining paper, a thermal transfer paper or the like are exemplified, and the wood free paper, the lightweight coated paper, the slightly coated paper, the coated paper, the thermal transfer paper and the like are preferable. The coated paper is obtained by coating a mixture, which is prepared by adding calcium carbonate, talc or the like into SRB latex or the like, on a base paper. An undercoat layer disposed on the above coated paper prevents the coating liquid for a foam layer from permeating into the substrate. There are a resin impregnated paper and a cast coated paper with a water resistance property. However, those papers are different in the texture of the surface gloss and surface feature from that of the plain paper. Furthermore, those papers become expensive, thus not preferable.

When the same paper as used for various printings such as a gravure printing, an offset printing, a screen process printing and the like is used as a substrate, it is possible to conduct a trial printing for a proofread with the use of the thermal transfer image receiving sheet of the present invention, but with the use of no printing plate.

The thickness of the substrate is usually within a range of 40 to 300 $\mu$m, preferably 60 to 200 $\mu$m. In order to obtain the thermal transfer image receiving sheet having the texture of a plain paper at high degree, a total thickness of the thermal transfer image receiving sheet is preferably within a range of 80 to 200 $\mu$m. The thickness of the substrate is calculated by subtracting a total thickness of the undercoat layer, the foam layer, the intermediate layer, the receptor layer and the like (about 30 to 80 $\mu$m in solid state) from the above total thickness of the thermal transfer image receiving sheet.

Furthermore, when the substrate having a thickness up to 90 $\mu$m is used, it is preferable to dispose the undercoat layer on the substrate, because wrinkles are likely produced upon absorbing water.

[RECEPTOR LAYER]

The receptor layer 4 is formed by applying a coating liquid for the receptor layer to the intermediate layer and dried. The above coating liquid for the receptor layer is prepared in such manner that the resin likely dyed by coloring materials is dissolved or dispersed in the solvent. The coating liquid for the receptor layer preferably contains the organic solvent to enable to dissolve the binder resin of the intermediate layer. The coating liquid for the receptor layer containing the organic solvent is prepared by adding various additives such as a release agent into the varnish comprising essentially the resin likely dyed by coloring materials, as required. As the resin likely dyed by coloring materials, there may be used: polyolefin resin such as polypropylene and the like; halide resin such as polyvinyl chloride, polyvinylidene choloride and the like; vinyl resin such as polyvinyl acetate, polyacrylate and the like and the copolymer thereof; polyester resin such as polyethylene terephthalate, polybutylene terephthalate and the like; polystyrene resin; polyamide resin; the copolymer prepared by polymerizing olefin such as ethylene, propylene and the like with the other vinyl monomer; ionomer; cellulose derivative per se, a mixture thereof or a copolymer thereof. The polyester resin and vinyl resin are preferable among the above.

A release agent may be contained in the receptor layer 4 in order to prevent a heat fusion with a thermal transfer sheet upon forming an image. As a release agent, silicone oil, phosphoric ester type plasticizer and fluorine compound may be used. In particular, the silicone oil is preferable. As the silicone oil, there may be used: modified silicone oil such as epoxy-modified, alkyl-modified, amino-modified, carboxyl-modified, alcohol-modified, fluorine-modified, alkyl aralkyl polyether-modified, epoxy/polyether-modified, polyether-modified or the like. A reaction product obtained by reacting the vinyl modified silicone oil with the hydrogen modified silicone oil is particularly preferable among the above. The addition amount of the release agent is preferably within a range of 0.2 to 30 weight parts to 100 weight parts of the resin forming the receptor layer.

The receptor layer and the other layers described later are formed by a widely used coating methods such as a roll coating, a bar coating, a gravure coating, a gravure reverse coating and the like. A coating amount of the receptor layer is preferably within a range of 0.5 to 10 g/m$^2$ (in solid component, hereinafter a coating amount is expressed by a value in solid component).

[UNDERCOAT LAYER]

In the present invention, it is preferable to form an under coat layer 5 between the substrate and the foam layer. With the under coat layer 5 formed on the substrate, when a coating liquid for a foam layer is applied on the substrate, the foam layer having a required thickness can be formed without the permeation of the coating liquid into the substrate. Furthermore, when the foam layer is caused to foam by heating, a foaming magnification becomes higher and a total cushion property of the thermal transfer image receiving sheet is improved. In addition, the necessary amount of the coating liquid for the foam layer is lowered to obtain the required thickness of the foam layer, thus economical.

As a resin used for the undercoat layer, a known resin such as acrylic resin, polyurethane resin, polyester resin, polyolefin resin, polyamide resin, and modified resin thereof are exemplified.

Furthermore, since a plain paper is used as a substrate in the present invention, when an aqueous coating liquid for an undercoat layer is directly applied thereon, wrinkles or undulations are caused on the substrate because of the uneven water absorbing property of the substrate surface, affecting the texture of the sheet and quality of the printed image. This tendency obviously appears in particular when the substrate having a thickness up to 100 $\mu$m is used. Accordingly, as the coating liquid for the undercoat layer, not an aqueous coating liquid, but a coating liquid with resin dissolved or dispersed in an organic solvent is preferably used.

As an organic solvent, there may be used: toluene, methyl ethyl ketone, isopropanol, butanol, ethyl acetate, and other industrial organic solvent are listed.

Extending pigment such as talc, calcium carbonate, titanium oxide, barium sulfate or the like may be added to improve a coating suitability of the undercoat layer per se, adhesiveness of the undercoat layer to the substrate and the foam layer (especially, an aqueous foaming agent is used in the foam layer), and to provide brightness. The addition amount of the above pigment is preferably within a range of 10 to 500 weight parts to 100 weight parts of resinous solid component. With the amount under 10 parts, the effect of the added pigment does not appear. With the amount over 500 parts, the resin property in the undercoat layer does not function.

The coating amount of the undercoat layer is preferably within a range of 1 to 20 g/m$^2$. With the amount under 1 g/m$^2$, the effect of the undercoat layer is not obtained. With the amount over 20 g/m$^2$, the effect is no longer improved, and furthermore the texture of the substrate is affected to become a texture like a synthetic resin sheet. In addition, with an excessive coating amount, the cost of the materials becomes expensive and uneconomical.

[FOAM LAYER]

The foam layer 2 formed on the substrate is formed from a resin and a foaming agent. Since the foam layer 2 has a high cushion property and a thermal insulating property, even if the paper is used as the substrate, the thermal transfer image receiving sheet having a high printing sensitivity may be obtained.

As the resin constituting the foam layer, a known resin such as urethane resin, acrylic resin, methacrylate resin, modified olefin resin, or a mixture or copolymer thereof may be used. The foam layer is formed by mixing the above resin dissolved or dispersed in an organic solvent or water with a foaming agent, and coating thus mixed substance. However, since a certain kind of organic solvents, for example, ketone such as acetone, methyl ethyl ketone or the like, ester such as ethyl acetate or butyl acetate, and lower alcohol such as methanol, ethanol or the like has a property to damage walls of the foaming agent, it is therefore preferable to use an aqueous coating liquid not affecting the foaming agent as the coating liquid for the foam layer.

More specifically, as a resin binder for a foam layer, there may be used: a water soluble resin; a water dispersible resin; emulsion such as SBR latex, urethane emulsion, polyester emulsion, emulsion of vinyl acetate and copolymer thereof, emulsion of acrylic polymer and acrylic copolymer including acrylic styrene, vinyl chloride emulsion; dispersion prepared with the use of the same resin as those of the above emulsion; or the like.

When a microsphere described later is used as the foaming agent, it is preferable to use the emulsion of vinyl acetate or copolymer thereof, or the emulsion of acrylic polymer or copolymer including acrylic styrene among the above resin.

Since the glass transition point, flexibility and film forming property can be easily controlled by changing kinds of monomer for copolymerization and the compounding ratio thereof, the above resin is appropriate in the following points that a required material property can be obtained without adding a plasticizer or film forming assist agent, that a color change is very small when preserved under various conditions after the layer is formed, that an aging change of the material property is very small. The above SBR latex may be used, but not preferable, since the SBR latex is usually low in the glass transition point, likely causes a blocking, and likely causes yellowing during the preservation or after layer forming. The urethane emulsion is not preferable too, since there are many urethane emulsion containing solvents such as NMP, DMF or the like, which affects foaming agents. The polyester emulsion or dispersion or the vinyl chloride emulsion are generally high in the glass transition point, and the foaming property of the microsphere is caused to be inferior, thus not preferable in use, too. Furthermore, of the soft resins, the resin provided with flexibility by adding a plasticizer, is not preferable in use.

The foaming property of the foaming agent largely depends on the hardness of the resin. It is desirable that the glass transition point is within a range of −30 to 20° C., or the lowest film forming temperature is up to 20° C., in order that the foaming agent foams until it reaches the required foaming magnification. With the glass transition point over 20° C., the flexibility of the resin becomes short to lower the foaming property of the foaming agent. With the glass transition point under −30° C., the foam layer causes the blocking due to the adhesiveness of the resin. Such a blocking occurs between the foam layer and the back surface of the substrate when the substrate is rolled up after the foam layer is formed. Furthermore, when the thermal transfer image receiving sheet is cut off, there may be caused problems: that the resin of the foam layer sticks to the cutter blade to deteriorate the outward appearance of the thermal transfer image receiving sheet; that a cut sheet may have no exact dimension. The foaming agent with the lowest film forming temperature of at least 20° C. causes a deteriorated film forming upon coating and drying, thus producing a damaged surface such as cracks.

As a foaming agent, there may be used known foaming agents: for example, decomposing foaming agents such as dinitropentamethylenetetramen, diazoaminobenzene, azobisisobutyronitrile, azodicarboamide or the like which are decomposed by heating to produce gasses such as oxygen, carbon dioxide, nitrogen and the like; and a microsphere which is a microcapsule formed by wrapping a low boiling point liquid such as butane, pentane or the like with the resin such as polyvinylidene chloride, polyacrylonitrile or the like. Of the above foaming agent, it is preferable to use the microsphere which is a microcapsule formed by wrapping a low boiling point liquid such as butane, pentane or the like with the resin such as polyvinylidene chloride, polyacrylonitrile or the like. The above foaming agents foam by heating after the foam layer is formed on the substrate, and has a high cushion property and thermal insulating property after foaming. The amount of the foaming agent is preferably within a range of 0.5 to 100 weight parts to 100 weight parts of the resin forming the foam layer. With the amount of under 0.5 weight parts, the cushion property of the foam layer is so low that no effect can be obtained by forming of the foam layer. With the amount of over 100 weight parts, the ratio of the hollow space in the foam layer after foaming is so large that the mechanical strength of the foam layer becomes so low with the result that the usual treatment and handling thereof cannot be sustained. Furthermore, the surface of the foam layer loses smoothness, affecting the outward appearance and quality of the printed image. In addition, the total thickness of the foam layer is preferably within a range of 30 to 100 $\mu$m (in solid component). With the thickness under 30 $\mu$m, the cushion property or thermal insulating property becomes short. With the thickness over 100 $\mu$m, the effect of the foam layer is no longer improved, and the strength thereof is lowered to deteriorate the scratch resistance, thus not preferable.

The particle size of the foaming agent is preferably within a range of 5 to 15 $\mu$m for average particle size in volume (which is expressed by the cube root of average volume of the particle substance) before foaming, and within a range of 20 to 50 $\mu$m after foaming. With the average particle size in volume before foaming under 5 $\mu$m and the particle size after foaming under 20 $\mu$m, the cushion effect is low. With the average particle size in volume before foaming over 15 $\mu$m and the particle size after foaming over 50 $\mu$m, the surface of the foam layer becomes rough, thus affecting quality of the formed image and not preferable.

The most preferable foaming agent is the low temperature foaming type microsphere having the softening temperature of the capsule walls and the starting temperature of the foaming of up to 100° C., and also having the optimum temperature, i.e., a temperature at which the foam magnification reaches the highest for one minute of a heating time, of foaming of up to 140° C., and the above foaming agent is preferably heated upon foaming as low as possible. By using the microsphere having a low foaming temperature as the foaming agent, it is possible to prevent wrinkles and curl of the substrate caused by heat upon foaming. The preferable microsphere described above is obtained by adjusting the addition amount of the thermoplastic resin forming the capsule walls such as polyvinylidene chloride, polyacrylonitrile or the like. The average particle size in volume before foaming is preferably within a range of 5 to 15 μm. The foam layer using the above microsphere has such merits that the obtained foams are independent foams, that the foaming is carried out only by a simple heating process, and that the thickness of the foam layer is easily controlled by the addition amount of the microsphere.

However, the microsphere is weak to an organic solvent. When the coating liquid for a foam layer containing an organic solvent is used, the walls of the microsphere are damaged to lower foaming property. Accordingly, when the microsphere is used, it is preferable to use an aqueous coating liquid for a foam layer not containing the organic solvent which damages walls, for example, ketone such as acetone or methyl ethyl ketone, ester such as ethyl acetate, lower alcohol such as methanol or ethanol, or the like. It is therefore preferable to use an aqueous coating liquid, i.e., the aqueous coating liquid using a water soluble or water dispersible resin, or emulsion of resin, particularly, acrylic styrene emulsion or modified vinyl acetate emulsion. Even if the foam layer is formed from the aqueous coating liquid, since the coating liquid added with an assist solvent, assist film forming agent, or a plasticizer such as a solvent having a high boiling point and high polarity such as NMP, DMF, cellosolve and the like affects the microsphere, it is necessary to confirm whether the coating liquid affects the microsphere or not by checking the composition of the aqueous resin as well as the amount of the solvent having a high boiling point to be added.

For example, when it is used for a printing of proof reading, the surface tone of the thermal transfer image receiving sheet as the printing material for proof reading is desirably the same as the tone of the corresponding paper to be printed. The surface tone of the thermal transfer image receiving sheet can be adjusted as required by containing a coloring material such as various tinting pigments, dyes, fluorescent whitening agent in the foam layer. The coloring material is contained in the amount so as to obtain the desired tone, and therefore there is no limitation in the amount.

As the pigment, for example, calcium carbonate, talc, kaolin, titanium oxide, zinc oxide and other known pigments are listed. The compounding ratio of the pigment is preferably within a range of 10 to 200 weight parts to 100 weight parts of resinous solid component. With the compounding ratio of the pigment under 10 weight parts, the effect obtained by the tone adjustment is too small. With the compounding ratio of the pigment over 200 weight parts, the dispersion stability of the pigment in the foam layer deteriorates, and furthermore, the function of the resin in the foam layer may not be obtained.

[INTERMEDIATE LAYER]

An intermediate layer 3 is formed on the foam layer to protect the foams in the foam layer from the thermal and mechanical shocks upon printing an image.

When a coating liquid for an intermediate layer is an organic solvent type coating liquid, i.e, the coating liquid prepared by using the solvent comprising essentially an organic solvent, the coating liquid applied on the foam layer damages the foam layer to lose the effect of the cushion property by the foam layer. The intermediate layer between the foam layer and the receptor layer may be formed by applying an aqueous coating liquid to overcome the above problem. As the aqueous coating liquid for the intermediate layer, the coating liquid which does not contain organic solvents, for example, such as ketone such as acetone or methyl ethyl ketone, ester such as ethyl acetate or butyl acetate, lower alcohol such as methanol or ethanol and the like, is preferable. More specifically, the coating liquid using a water soluble or water dispersible resin, or emulsion of resin, preferably acrylic styrene emulsion is desirable.

Inorganic pigment such as calcium carbonate, talc, kaolin, titanium oxide, zinc oxide, barium sulfate and other known inorganic pigments, or fluorescent whitening agent, or coloring material may be contained in the above intermediate layer or foam layer in order to provide the hiding property and whitening property, or in order to adjust the texture of the thermal transfer image receiving sheet. The compounding ratio thereof is preferably within a range of 10 to 200 weight parts to 100 weight parts of resinous solid component. With the compounding ratio of the inorganic pigment under 10 weight parts, the effect of the hiding property and whitening property is too small. With the compounding ratio of the inorganic pigment over 200 weight parts, the dispersion stability of the coating liquid deteriorates, and furthermore, the required function of the resin may not be obtained.

In the present invention, the intermediate layer having fine pores (i.e., fine voids) is formed in order to remove the discontinuity in gradations produced when a mixed color image is printed. The intermediate layer has a discontinuous structure comprising a mixture of the matrix material of the intermediate layer and fine voids into which the coating liquid for a receptor layer may permeates, thus the material of the intermediate layer is not uniformly distributed. As an appropriate example of the intermediate layer having the discontinuous structure, there may be listed the intermediate layer containing resin particles having a diameter (particle size) of 0.1 to 2 μm. The above intermediate layer is obtained by applying the coating liquid for an intermediate layer containing the resin particles having a diameter of 0.1 to 2 μm onto the foam layer.

As the resin particles, there are known, for example, the resin particles formed from a styrene-acrylic copolymer resin, other thermoplastic resin, or cross linking substance thereof. As more specific product, there are listed: PP204P and PP102P manufactured by Mitsuitoatsu chemical Co. Ltd. respectively; HP91, OP84J, OP62 manufactured by Roam and Haas Co. Ltd. respectively; or the like.

There are various such shapes of the resin particles as sphere, hollow, compressed, multi-particles assembly and the like, any of which is effective. The diameter (i.e, particle size) is preferably within a range of 0.1 to 2 μm. With a diameter under 0.1 μm, a sufficient void space around the particle is not formed after the intermediate layer is formed, thus the effect to improve adhesiveness of the intermediate layer to the receptor layer may not be obtained. With a diameter over 2 μm, the resin particles protrude off the surface of the intermediate layer, thus affecting the quality of the surface of the printed image. Furthermore, since the density of the resin particle is larger than that of water, when the particle becomes large, the resin particles are separated in the coating liquid.

The compounding ratio of the resin particle is preferably within a range of 10 to 300 weight parts to 100 weight parts in solid component of the binder resin. With the compounding ratio under 10 weight parts, the required effect may not be obtained. With the compounding ratio over 300 weight parts, the dispersion stability of the resin particles lowers, and properties of the binder resin such as the flexibility is deteriorated.

The intermediate layer having the discontinuous structure comprising a mixture of the matrix material of the intermediate layer and fine voids may also be formed by applying a coating liquid for an intermediate layer comprising a high polymer resin, a good solvent and a bad solvent, and being dried. More specifically, when the coating liquid containing at least (1) a high polymer resin, (2) a good solvent having a higher dissolving property to the high polymer resin, and (3) a bad solvent having a lower dissolving property to the high polymer resin than that of the good solvent and having a higher boiling point than that of the good solvent is applied onto the foam layer, during the drying, at first the good solvent having a lower boiling point evaporates to cause the mixed solvent with the resin dissolved thereinto to be imbalance, thus a part of the resin comes to be undissolved, whitely turbid, precipitated or partially gelled, and then, the bad solvent evaporates along with the proceeding of the drying, to obtain a porous intermediate layer.

The diameter of the fine pores of thus formed porous intermediate layer is preferably within a range of 0.1 to 3 μm. The diameter of the fine pores is controlled within the above range by optimizing the drying temperature, the volume velocity of the drying air, the drying time and the compounding ratio of the good solvent and the bad solvent. With the diameter of the fine pores under 0.1 μm, it is difficult to have the discontinuous structure comprising a mixture of the matrix material of the intermediate layer and a sufficient amount of the fine voids. With the diameter of the fine pores over 3 μm, the strength of the intermediate layer is lowered.

As the high polymer resin used for the intermediate layer, acrylic resin, polyester resin or vinyl chloride-vinyl acetate copolymer is preferable. The high polymer resin preferably has glass transition point within a range of 30 to 150° C., more preferably within a range of 50 to 130° C. With the glass transition point over 150° C., the flexibility of the high polymer resin is lost to become hard, thus deteriorating the cushion property of the intermediate layer. With the glass transition point under 30° C., the preservable property thereof deteriorates, thus not desirable.

When the high polymer resin to be used is easily dissolved in an organic solvent, there may preferably be used as the bad solvent: hydrocarbon solvent such as aliphatic hydrocarbon, aromatic hydrocarbon or terpene hydrocarbon; halide hydrocarbon; alcohol; or the like. As the good solvent to the above high polymer resin being easily dissolved in an organic solvent, there may preferably be used: ketone such as acetone, methyl ethyl ketone or cyclohexanone; ester such as ethyl acetate, butyl acetate or ethylene glycol acetate mono methyl ether; or the like. Furthermore, to some resin, there may be used aromatic hydrocarbon or alcohol.

On the other hand, when a water soluble resin is used as the high polymer resin, the bad solvent to the high polymer resin dissolvable in the organic solvent becomes the good solvent, and the good solvent becomes the bad solvent, and the good solvent and the bad solvent are chosen in consideration to the relative dissolving property to the resin.

In order to keep the dispersion condition of the varnish stable, the good solvent and the bad solvent are selected in such a manner: that the two solvents are compatible with each other: and that the bad solvent has a boiling point higher than that of the good solvent, and evaporates at lower degree than the good solvent.

The resin varnish is formed by using 10 to 70 weight parts of bad solvent to 100 weight parts of high polymer resin to form effectively the discontinuous structure comprising a mixture of the matrix material of the intermediate layer and fine voids.

In either intermediate layer having the discontinuous structure, which is formed by containing resin particles having a diameter of 0.1 to 2 μm, or which is formed by applying the coating liquid for an intermediate layer containing a high polymer resin, a good solvent and a bad solvent, the coating amount of the intermediate layer is preferably within a range of 1 to 20 g/m$^2$. With the coating amount under 1 g/m$^2$, the function to protect the foam is not sufficiently effected by the intermediate layer. With the coating amount over 20 g/m$^2$, the thermal insulating property and the cushion property of the foam layer is not effectively functioned, thus not desirable.

[ANTI-CURL LAYER]

In the present invention, because used is the substrate comprising essentially pulp, the receptor side of which a plurality of resin layers are formed on, if the back side of the substrate is exposed as it is, the thermal transfer image receiving sheet may be curled by the moisture and temperature in the surroundings. Accordingly, it is preferable to form an anti-curl layer 6 comprising essentially resin having a water-hold effect such as polyvinyl alcohol, polyethylene glycol, glycerin or the like, on the back side of the substrate.

The functions such as stiffness, slip ability and the like may be provided to the anti-curl layer so as to adapt to the conveying system for the thermal transfer image receiving layer. In order to provide the slip ability for the anti-curl layer, an inorganic or organic filler is dispersed in the anti-curl layer 6. As the resin used for providing the stiffness and the slip ability, the known resin or blended resin thereof may be used. The slip agent such as silicone or release agent may be added in the anti-curl layer 6.

The coating amount of the anti-curl layer is preferably within a range of 0.05 to 3 g/m$^2$.

[METHOD OF MANUFACTURING THE THERMAL TRANSFER IMAGE RECEIVING SHEET]

A method of manufacturing a thermal transfer image receiving sheet of the present invention comprises a step that at least an intermediate layer and a receptor layer are disposed on a substrate made of a paper comprising essentially pulp, the intermediate layer and the receptor layer being disposed in order from the substrate, wherein the intermediate layer, which has a structure comprising fine pores, is formed on the substrate, and the receptor layer is formed on the intermediate layer.

In the method of the invention, it is preferable that resin particles having a diameter of 0.1 to 2 μm is contained in the intermediate layer to form the discontinuous structure.

In the method of the invention, it is preferable that a coating liquid for an intermediate layer comprising a high polymer resin, a good solvent and a bad solvent is applied on the substrate and dried to form the discontinuous structure.

In the method of the invention, it is preferable that a foam layer is disposed between the substrate and the intermediate layer.

The method of manufacturing the intermediate layer having the discontinuous structure comprising the above fine pores is the same as described in "INTERMEDIATE LAYER" above. Therefore, the detailed description of the method is neglected. The method of manufacturing the foam layer is also neglected as same as the above.

The thermal transfer sheet is used in combination with the above thermal transfer image receiving sheet when the thermal transfer is carried out. As the thermal transfer sheet, there is used the sublimation type thermal transfer sheet used in the sublimation type transfer recording. In addition, there is used the heat fusion type thermal transfer sheet, the substrate of which is provided with a heat fusible ink layer in which a coloring material such as pigment is carried in a heat fusible binder. The heat fusible ink layer formed on the substrate is thermally transferred per se to the image-receiving material.

As the means to furnish the thermal energy upon the thermal transfer, there may be applicable all the known means. For example, the recording time is controlled by means of the recording apparatus such as the thermal printer (for example, Videoprinter-VY-100 manufactured by Hitachi Seisakusho Co. Ltd.) to furnish the thermal energy of about 5 to 100 mJ/mm$^2$, thus forming the image.

As described above, since the thermal transfer image receiving sheet of the present invention is formed in such manner that the substrate made of a paper comprising essentially pulp is used, and that at least intermediate layer and receptor layer are formed in this order on the substrate, and further that the intermediate layer has a discontinuous structure comprising fine pores, the following desirable effects can be obtained: the adhesiveness between the receptor layer and the intermediate layer is improved, the discontinuity of the gradation upon printing with the mixed colors is prevented, the texture such as the gloss and surface features is the same as that of the plain paper, and the high quality of image excellent in reproducibility of the intermediate colors and excellent in gradation reproducibility can be formed.

The present invention is explained in detail with reference to the example of the present invention and the example for comparison.

EXAMPLE

Example 1

The coat paper having a basis weight of 104.7 g/m$^2$ (NEW V MATT manufactured by Mitsubish Seishi Co. Ltd.) is used as the substrate. The coating liquid for a foam layer having the following composition is applied on the above substrate by the gravure coating to form a layer having in an coating amount of 25 g/m$^2$ (in solid component, hereinafter expressed by same manner), then dried at the temperature of 140° C. for one minutes to cause the microsphere to foam, thus forming the foam layer. The composition is expressed by weight parts.

| <Coating Liquid for Foam Layer> | |
|---|---|
| Styrene-acryl emulsion (RX941A, manufactured by Nippon Carbaide Industries Co., Inc.) | 100 weight parts |
| Microsphere (F30VS, manufactured by Matsumoto Yushi Seiyaku Co. Ltd.) | 10 weight parts |
| Water | 20 weight parts. |

Then, the coating liquid for an intermediate layer having the following composition is applied on the above foam layer by the gravure coating to form a layer in a coating amount of 5 g/m$^2$, then heated and dried by the hot air dryer to form the intermediate layer.

| <Coating Liquid for Intermediate Layer> | |
|---|---|
| Styrene-acryl emulsion (RX832A, manufactured by Nippon Carbaide Industries Co., Inc.) | 100 weight parts |
| Genuine sphere type resin particle (PP204P, diameter of the particle: 0.2 μm, manufactured by Mitsui Toatsu Kagaku Co. Ltd.) | 100 weight parts |
| Water | 20 weight parts. |

Then, the coating liquid for a receptor layer having the following composition is applied on the above intermediate layer by the gravure coating to form a layer in a coating amount of 3 g/m$^2$, then heated and dried by the hot air dryer to obtain the thermal transfer image receiving sheet of Example 1.

| <Coating Liquid for Receptor Layer> | |
|---|---|
| Vinyl chloride-vinyl acetate copolymer (#1000D, manufactured by Denki Kagaku Kogyo Co. Ltd.) | 100 weight parts |
| Amino modified silicone (X-22-349, manufactured by Shinetsu Kagaku Kogyo Co. Ltd.) | 3 weight parts |
| Epoxy modified silicone (KF-393, manufactured by Shinetsu Kagaku Kogyo Co. Ltd.) | 3 weight parts |
| Methyl ethyl ketone/Toluene (1/1) | 400 weight parts. |

Example 2

The thermal transfer image receiving sheet of the Example 2 is obtained in the same manner described in Example 1 except the following condition.

The composition of the coating liquid for an intermediate layer is changed to the following, and furthermore, the coating liquid for an undercoat layer having the following composition is applied on the substrate by the gravure coating to form a layer in a coating amount of 5 g/m$^2$, then dried by the hot air dryer to form the undercoat layer between the substrate and the foam layer. Furthermore, the foam layer in a coating amount of 20 g/m$^2$ is formed by the gravure coating.

| <Coating Liquid for Intermediate Layer> | |
|---|---|
| Styrene-acryl emulsion (RX941A, manufactured by Nippon Carbaide Industries Co., Inc.) | 100 weight parts |
| Genuine sphere type resin particle (PP102P, diameter of the particle: 0.6 μm, manufactured by Mitsui Toatsu Kagaku Co. Ltd.) | 150 weight parts |
| Water | 20 weight parts. |
| **<Coating Liquid for Undercoat Layer>** | |
| Polyester resin (V600, manufactured by Toyoboseki Co. Ltd.) | 100 weight parts |
| Metyl ethyl ketone/Toluene (1/1) | 400 weight parts. |

Example 3

The thermal transfer image receiving sheet of the Example 3 is obtained in the same manner described in Example 1 except the following condition.

The composition of the coating liquid for an intermediate layer is changed to the following, and furthermore, the coating liquid for an anti-curl layer having the following composition is applied on the opposite side of the substrate with the receptor layer formed by the gravure coating to form a layer in a coating amount of 0.05 g/m$^2$, then dried by the cool air dryer to form the anti-curl layer on the other side of the substrate.

| <Coating Liquid for Intermediate Layer> | |
|---|---|
| Styrene-acryl emulsion (XA4270C, manufactured by Tohpe Corporation) | 100 weight parts |
| Hollow type resin particle (HP91, particle size: 1.0 μm, manufactured by Rome and Haas Co. Ltd.) | 150 weight parts |
| Titanium oxide (TT-055(A), manufactured by Ishihara Sangyo Co. Ltd.) | 50 weight parts |
| Water | 20 weight parts. |
| <Coating Liquid for Anti-Curl Layer> | |
| Polyvinyl alcohol (PVA124, manufactured by Kuraray Co. Ltd.) | 2 weight parts |
| Water | 100 weight parts. |

Example 4

The thermal transfer image receiving sheet of the Example 4 is obtained in the same manner described in Example 1 except the following condition.

The composition of the coating liquid for an intermediate layer is changed to the following.

| <Coating Liquid for Intermediate Layer> | |
|---|---|
| Styrene-acryl emulsion (XA4270C, manufactured by Tohpe Corporation) | 100 weight parts |
| Hollow type resin particle (OP84J, particle size: 0.55 μm, manufactured by Rome and Haas Co. Ltd.) | 150 weight parts |
| Titanium oxide (TT-055(A), manufactured by Ishihara Sangyo Co. Ltd.) | 50 weight parts |
| Water | 20 weight parts. |

Example 5

The thermal transfer image receiving sheet of the Example 5 is obtained in the same manner described in Example 1 except the following condition.

The composition of the coating liquid for an intermediate layer is changed to the following.

| <Coating Liquid for Intermediate Layer> | |
|---|---|
| Styrene-acryl emulsion (XA4270C, manufactured by Tohpe Corporation) | 100 weight parts |
| Hollow type resin particle (OP62, particle size: 0.45 μm, manufactured by Rome and Haas Co. Ltd.) | 150 weight parts |
| Titanium oxide (TT-055(A), manufactured by Ishihara Sangyo Co. Ltd.) | 50 weight parts |
| Water | 20 weight parts. |

Comparison Example 1

The thermal transfer image receiving sheet for Comparison Example 1 is obtained in the same manner described in Example 1 except the following condition.

The composition of the coating liquid for an intermediate layer is changed to the following.

| <Coating Liquid for Intermediate Layer> | |
|---|---|
| Styrene-acryl emulsion (RX832A, manufactured by Nippon Carbaide Industries Co., Inc.) | 100 weight parts |
| Water | 20 weight parts. |

Comparison Example 2

The thermal transfer image receiving sheet for Comparison Example 2 is obtained in the same manner described in Example 1 except the following condition.

The composition of the coating liquid for an intermediate layer is changed to the following.

| <Coating Liquid for Intermediate Layer> | |
|---|---|
| Styrene-acryl emulsion (XA4270C, manufactured by Tohpe Corporation) | 100 weight parts |
| Titanium oxide (TT-055(A), manufactured by Ishihara Sangyo Co. Ltd.) | 50 weight parts |
| Water | 20 weight parts. |

The thermal transfer image receiving sheets thus prepared were subjected to the quality evaluation of the printed image with the use of the following printer and dye thermal transfer sheet. The evaluation process is as follows:

| <Sublimation type color printer> |
|---|
| Rainbow 2720, manufactured by Sumitomo 3M Co. Ltd. |
| <Dye Thermal Transfer Sheet> |
| Color ribon (Y, M, C and Bk-four colors) for Rainbow 2720, manufactured by Sumitomo 3M Co. Ltd. |
| (Quality Evaluation of Printed Image) |

Firstly, the gradation comprising from 0%/100% to 50%/100% gradation is printed on the thermal transfer image receiving sheet by the single yellow (Ye) color. Then, the solid comprising 60%/100% gradation is printed by the single magenta (Mg) color on the same region as the above. The quality of the printed image were evaluated by sense with eye-observation. The standard of the evaluation are as follows:

◎: No discontinuous gradation was observed in the image, and the quality is excellent.

○: Discontinuous gradation was almost not observed in the image, and no problem in practical use in quality.

X: Discontinuous gradation was observed in the image, and the quality has a problem in practical use.

The results are shown in Table 1.

TABLE 1

| | Quality of Printed Image |
|---|---|
| Example 1 | ○ |
| Example 2 | ○ |
| Example 3 | ◎ |
| Example 4 | ◎ |
| Example 5 | ◎ |

TABLE 1-continued

| | Quality of Printed Image |
|---|---|
| Comparison 1 | x |
| Comparison 2 | x |

Figure 3:
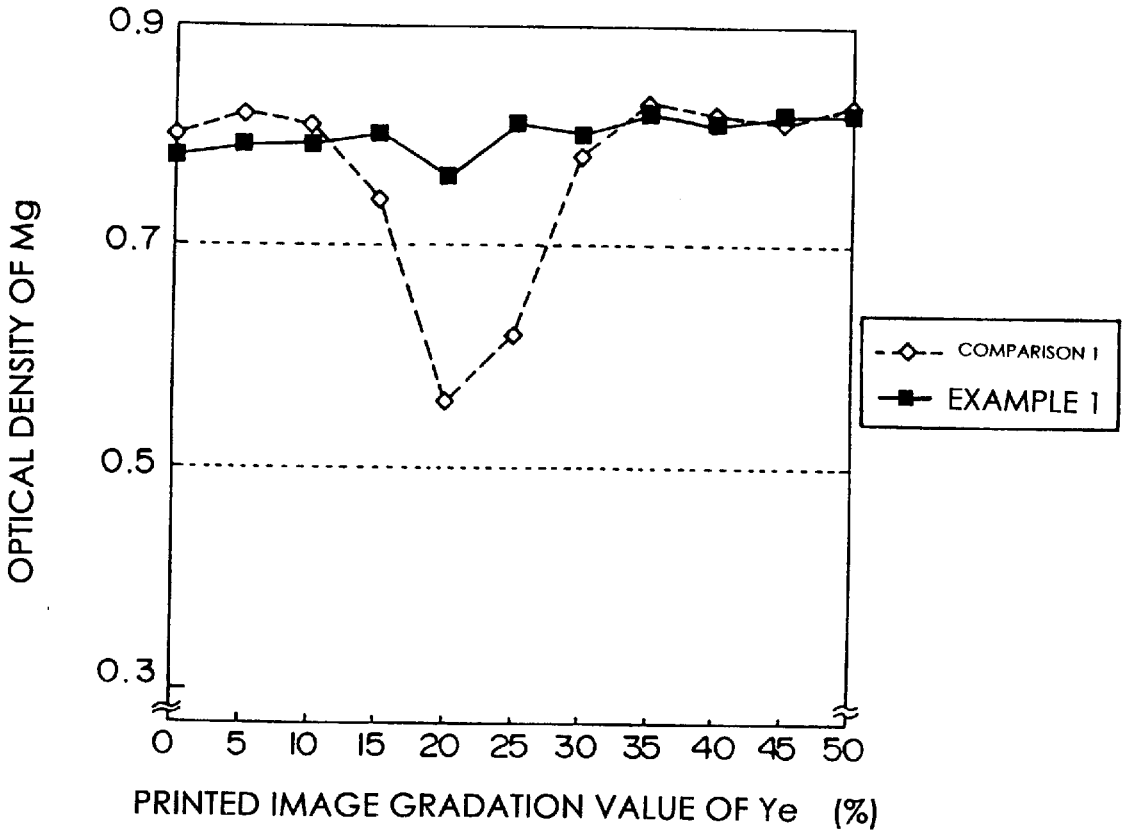
FIG. 3 is a graph showing the relationship between the optical density of Mg and the printed image gradation value of Ye.

Furthermore, the image receiving sheets of Example 1 and Comparison Example 1 were subjected to the thermal transfer printing in the above condition, and then, the optical densities of the Mg component were measured by means of the measuring apparatus Macbeth RD-918 with respect to the respective image receiving sheets. The results were shown in FIG. 3. In FIG. 3, the printed image gradation value of Ye (%/100%) is plotted along the horizontal axis, and the optical density of Mg is plotted along the vertical axis.

In addition to the above printed image quality evaluation, since the undercoat layer, the foam layer, the intermediate layer and the receptor layer are formed on the substrate in this order in Example 2, the coating liquid for a foam layer did not permeates into the substrate because of the undercoat layer. The coating amount of the foam layer could be reduced in comparison with the other Examples without the undercoat layers, thus economical.

Since the anti-curl layer was disposed in the Example 3 on the opposite side of the substrate with the receptor layer formed, the printed matter of Example 3 was little curled in the low moisture condition in comparison with the other Examples having no anti-curl layer, thus enabling to prevent curl.

What is claimed is:

1. A method of manufacturing a thermal transfer image receiving sheet which comprises a substrate made of a paper comprising essentially pulp, a foam layer having a cushioning property, an intermediate layer, and a receptor layer, which are disposed in this order on said substrate, the method comprising steps of:

forming the foam layer having a cushioning property on the substrate;

forming said intermediate layer having a structure comprising fine pores on said foam layer, and forming said receptor layer on said intermediate layer.

2. A method as claimed in claim 1, wherein said receptor layer is formed by applying a coating liquid for a receptor layer on said intermediate layer.

3. A method as claimed in claim 1, wherein said intermediate layer containing a binder resin is formed on said substrate, and said receptor layer is formed by applying a coating liquid for a receptor layer containing an organic solvent on said intermediate layer.

4. A method as claimed in claim 1, wherein a coating liquid for an intermediate layer containing resin particles having a diameter of 0.1 to 2 $\mu$m is applied on said substrate and dried to form said intermediate layer having said structure comprising said fine pores.

5. A method as claimed in claim 1, wherein a coating liquid for an intermediate layer containing a polymer resin, a first solvent and a second solvent having a lower dissolving property to said polymer resin than that of said first solvent and having a higher boiling point than that of said first solvent is applied on said substrate and dried to form said intermediate layer having said structure comprising said fine pores.

6. A method as claimed in claim 5, wherein 10 to 70 weight parts of said second solvent is used to 100 weight parts of said polymer resin.

7. A thermal transfer image receiving sheet comprising:

a substrate made of paper essentially comprising pulp;

a foam layer having a cushioning property;

an intermediate layer having a structure comprising fine pores; and a receptor layer wherein said foam layer, said intermediate layer and said receptor layer are disposed in this order on said substrate.

8. A thermal transfer image receiving sheet as claimed in claim 7, wherein said receptor layer is formed by applying a coating liquid for a receptor layer on said intermediate layer.

9. A thermal transfer image receiving sheet as claimed in claim 7, wherein said intermediate layer contains a binder resin, and said receptor layer is formed by applying a coating liquid for a receptor layer containing an organic solvent on said intermediate layer.

10. A thermal transfer image receiving sheet as claimed in claim 7, wherein said intermediate layer contains resin particles having a diameter of 0.1 to 2 $\mu$m.

11. A thermal transfer image receiving sheet as claimed in claim 7, wherein said intermediate layer is formed on said foam layer by applying a coating liquid for an intermediate layer containing a polymer resin, a first solvent and a second solvent having a lower dissolving property to said polymer resin than that of said first solvent and having a higher boiling point than that of said first solvent, and dried.

12. A thermal transfer image receiving sheet as claimed in claim 11, wherein said intermediate layer comprises the fine pores having diameters in a range of 0.1 to 3 $\mu$m.

13. A thermal transfer image receiving sheet as claimed in claim 7, wherein an undercoat layer is disposed between said substrate and said foam layer.

14. A thermal transfer image receiving sheet as claimed in claim 7, wherein an anti-curl layer is disposed on an opposite surface of said substrate with said receptor layer formed thereon.

* * * * *